United States Patent [19]

Brown, deceased et al.

[11] 4,074,774

[45] Feb. 21, 1978

[54] DRILLING ASSEMBLY

[76] Inventors: Cicero C. Brown, deceased, late of Houston, Tex.; by Joe R. Brown, executor, P.O. Box 19236, Houston, Tex. 77024

[21] Appl. No.: 578,677

[22] Filed: May 19, 1975

[51] Int. Cl.[2] ..... E21B 7/00

[52] U.S. Cl. ..... 173/44; 173/149; 175/85

[58] Field of Search ..... 173/43, 149; 175/85; 285/DIG. 21, 18, 98, 94, 69; 294/86.25, 86.34; 81/72

[56] References Cited

U.S. PATENT DOCUMENTS

| | | | |
|---|---|---|---|
| 2,869,644 | 1/1959 | Brown | 294/86.34 |
| 3,265,431 | 8/1966 | Burner | 294/86.25 |
| 3,278,220 | 10/1966 | Wilson | 294/86.25 |
| 3,322,006 | 5/1967 | Brown | 166/117.7 |
| 3,451,493 | 6/1969 | Storm | 173/43 UX |
| 3,539,024 | 11/1970 | Irons | 175/85 |
| 3,638,969 | 2/1972 | Serrano | 285/96 X |
| 3,695,633 | 10/1972 | Hanes | 285/18 |
| 3,722,607 | 3/1973 | Ray | 173/149 X |
| 3,766,991 | 10/1973 | Brown | 175/85 |

*Primary Examiner*—Ernest R. Purser
*Assistant Examiner*—William F. Pate, III
*Attorney, Agent, or Firm*—Carlos A. Torres; E. Richard Zamecki

[57] ABSTRACT

A drilling machine and relatively small mast are mounted on a pivotal support which permits the drilling machine, mast and drill pipe employed in the assembly to be inclined as required to drill a non-vertical bore hole. The drilling machine is preferably a fluid pressure-operated snubber device which includes a stationary lower gripping head and a vertically reciprocable, upper gripping head operable for rotating drill pipe and for running the drill pipe into and out of the well bore. An internal drill string anchor carried by a traveling block suspended in the mast engages and supports the upper end of the drill string extending from the snubber and also provides drilling fluids to the string. A rotatable seal and support assembly in the anchor maintains a fluid seal and permits the drill pipe to rotate relative to the non-rotating traveling block. The anchor is equipped with slips which grip the internal surface of the drill string and are positively moved into and out of gripping engagement with the drill string by hydraulic controls. A spring bias is provided on the slips to urge the slips into their gripping position and means are provided which increase the gripping force of the slips in response to an increase in the forces tending to separate the drill string from the anchor.

Claims, 6 Drawing Figures

DRILLING ASSEMBLY

BACKGROUND OF THE INVENTION

The field of the present invention relates to means and techniques for forming inclined boreholes. A particular application of the invention is the formation of inclined boreholes for placement of pilings or for directional wells. More specifically, the invention relates to drilling apparatus in which a drilling machine and pipe handling derrick or mast may be inclined to form an inclined borehole.

It is frequently necessary in the construction or placement of offshore drilling platforms that inclined pilings be placed into the water bottom as support for a drilling or production platform. These inclined pilings are frequently positioned with the use of a floating vessel which carries a pile driver employed for pounding the pilings into place. In deeper waters, pile drivers cannot be employed for this purpose, and in some circumstances, it is necessary to employ large, expensive drill ships for the purpose of setting the pilings.

Well drilling apparatuses in which the mast may be pivotal away from the vertical position are well known. These assemblies are commonly employed to drill directional bore holes in shallow water marine drilling operations. An example of such an assembly is shown in U.S. Pat. No. 3,443,647. In this assembly, a substantially conventional mast, traveling block and rotary table mounted on a pivotal substructure and equipped with means such that the angle of inclination of the mast, rotary table and substructure may be varied as required. The drill string is rotated by the rotary table and is raised and lowered with the traveling block, in a customary fashion.

While the patented assembly provides many advantages, it is nevertheless relatively expensive and difficult to mount a conventional mast and rotary table for pivotal movement and to operate such a system while it is in an inclined position. Even in the conventional vertical configuration, a relatively large support vessel is required to mount such a system. In a system where the mast is to be inclined, an even larger, more expensive and complicated support vessel may be needed. Operation of such vessels in many shallow water locations would not be possible.

A modified form of drilling equipment which provides both the rotary and vertical pipe movements required in a conventional drilling or completion operation is described in U.S. Pat. No. 3,722,603. This assembly, referred to herein as a drilling snubber, employs a drilling head and a gripping head which cooperate to raise and lower the well pipe and to impart the desired rotary motion to the pipe. As more fully described in said U.S. Pat. No. 3,722,603, the snubber includes a rotatable vertically movable upper drilling head and a stationary, rotatable lower gripping head. Hydraulic cylinders raise and lower the drilling head and additional hydraulic controls cause elements in both heads to grip and release the pipe as required. Both the lower and upper heads are equipped with means for imparting a rotary motion to the well pipe through the gripping elements of the head.

In the operation of the drilling snubber, rotary motion for drilling a well is imparted to the drill pipe through the drilling head. As the drill bit advances through the formation, the drill string is lowered by appropriately actuating the hydraulic cylinders which move the drilling head downwardly toward the stationary lower head. During the drilling operation, the lower head is completely released from the drill string. When the drilling head reaches the lower limit of its movement, the lower head is actuated to grip the drill string, the upper drilling head then releases the drill string and the hydraulic cylinders are actuated to elevate the drilling head. The drilling head then re-engages the drill string, the lower head releases the drill string and the drilling operation is reinitiated.

Deviation of the well direction away from the vertical is conventionally accomplished in a drilling snubber operation by using a whipstock or subsurface turbine drill, much as such devices are employed to deviate well bores being drilled with the use of a standard rotary table. These devices typically require that a vertical, or near vertical, guide hole be drilled before the deviation is effected. Shallow well and pile setting applications, however, require immediate deviation of the bore hole from the surface so that conventional deviating devices are of little use.

SUMMARY OF THE INVENTION

A drilling snubber and mast are mounted for pivotal motion on a support structure whereby an inclined bore hole for pilings and other conduits may be drilled at an angle determined by the inclination of the support structure. The use of a drilling snubber as the drilling machine eliminates the need for a heavy mast which in turn reduces the size and strength requirements of the structure supporting the drilling assembly. The assembly of the present invention is therefore well suited for use on relatively small barges and other small vessels which may be inexpensively constructed and operated in many areas, including shallow water areas.

The drilling assembly of the present invention includes a novel anchoring means designed to engage the upper end of the drill pipe and to provide a leak-proof connection for the introduction of drilling fluid into the drill string. Slips provided in the anchoring means are driven by hydraulic action to positively grip or release the internal surfaces of the drill string. The slips are also permanently biased toward a gripping position by a mechanical spring to ensure gripping of the drill string without reliance on the application of hydraulic pressure. Weight responsive means included in the anchoring means increase the gripping force exerted by the slips against the drill pipe as the forces tending to separate the anchoring means from the drill pipe increase. The hydraulic actuation of the slips acts independently of the weight responsive system so that a firm grip of the drill pipe may be taken before any of the drill string weight is supplied to the anchoring head.

The anchor head is also provided with suitable swivel means whereby the drill pipe may be rotated while being secured to the anchor head. Rotary seals provided in the anchor head permit drilling fluid from a stationary source to be transmitted through the anchoring head into the rotating drill string.

By employing a drilling snubber for the drilling function, the mast need only handle a single length of tubing, drill string or other well pipe, which is normally of a length of approximately 30 feet. The make-up and break-out operations required to join and separate pipe joints are easily and quickly handled by the snubber. Moreover, since the mast need not support the entire drill string, the weight and strength of the mast may be substantially less than that of a conventional mast employed with a typical rotary table.

The use of a relatively small, light-weight mast in combination with the drilling snubber permits the tilting or pivoting equipment to be substantially simplified. Thus, a simple hydraulic cylinder may be employed to provide the necessary inclination to the mast and snubber without need for a large number of cables, offsets, and other structural supports which are commonly required where a standard size derrick using rotary table power is to be inclined.

Because of its simplicity and small size, the system of the present invention is less expensive to construct and is more quickly set up and used to drill inclined boreholes.

Accordingly, it is a primary object of the present invention to provide a drilling assembly which can be carried by relatively small support structures for drilling an inclined bore hole for the placement of pilings or for forming a directional well bore.

It is also an object of the present invention to mount a drilling snubber and relatively small capacity mast on a tiltable structure for drilling inclined bore holes.

An object of the present invention is to provide a drilling snubber and mast assembly which include a quick grip and release swivel head and mud supply anchor means for engaging the upper end of a section of well pipe whereby well fluids may be communicated between the rotating drill pipe and a remote stationary location.

It is also an object of the present invention to provide a gripping head which grasps the internal surface of a section of well pipe with slip means which may be powered into or out of engagement with the pipe.

It is a further object of the present invention to provide a weight responsive means in said anchoring head which increases the gripping force exerted by the slip means when the forces tending to pull the anchoring head and the well pipe longitudinally apart increase.

A further object of the present invention is to provide a constantly biased gripping means which urges the slips to a normally expanded position in which the slips grip the internal surface of the well pipe.

The foregoing features, advantages and objects of the present invention will be more fully understood from the following specification, claims and the related drawings.

DESCRIPTION OF THE ILLUSTRATED EMBODIMENT

Figure 1:
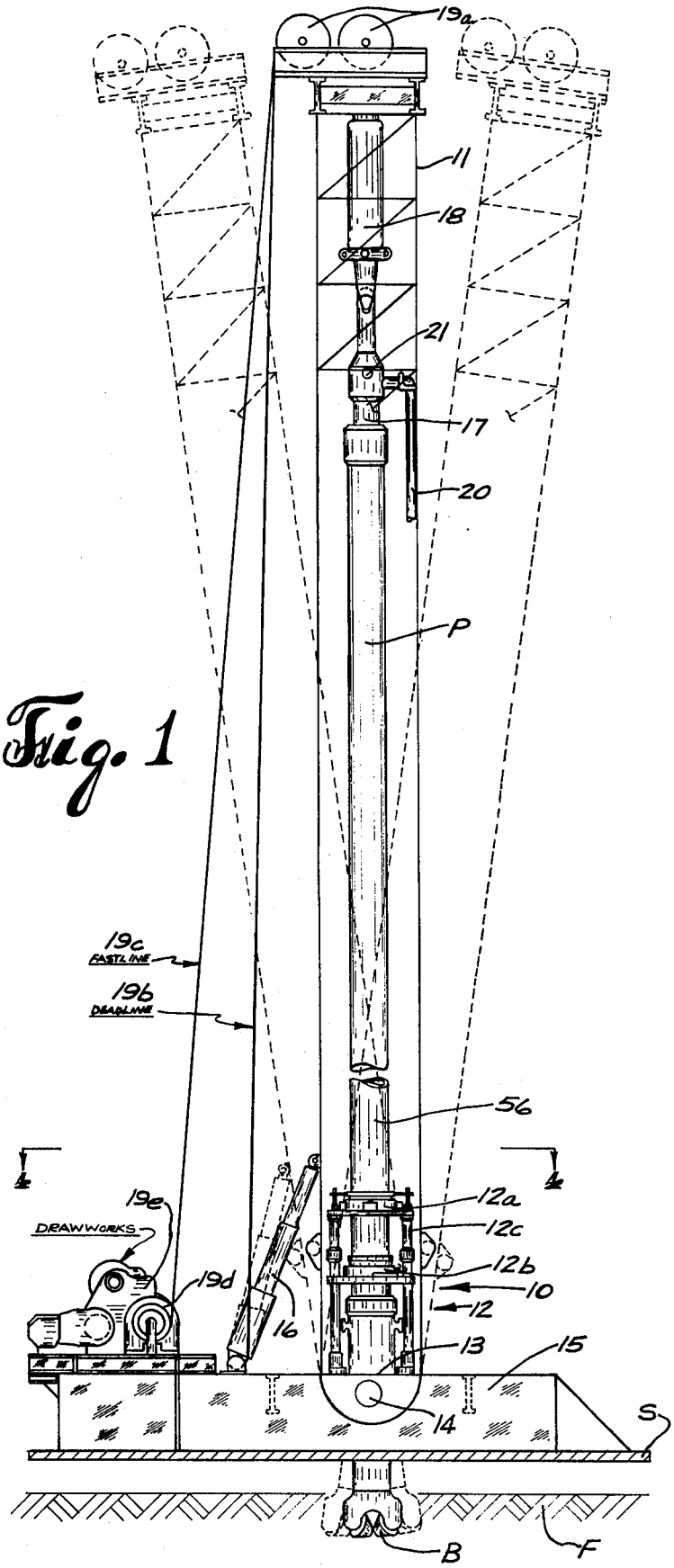
FIG. 1 is a vertical elevation, depicted schematically in part, illustrating the inclinable mast and drilling snubber assembly of the present invention.

The drilling assembly of the present invention is indicated generally at 10 mounted on a support means S which may comprise the deck of a barge or other small vessel. While the assembly 10 is described and illustrated mounted on a vessel, it will be appreciated that it may be employed on a variety of other land or marine vehicles or structures.

The assembly 10 includes a mast 11 and a drilling snubber, the latter being indicated generally at 12. In operation, the snubber 12 rotates a drill pipe section P and attached drill string and imparts vertical motion to the drill pipe section as required to mainpulate a drill bit B, at the bottom of the string, for the formation of a bore hole in the underlying earthen formation F. The snubber 12 includes a vertically movable drill head **12*a* and a stationary gripping head 12*b*. Either or both heads may be provided with powering means (not illustrated) for causing the pipe section P, and the drill string and bit connected to the pipe section, to rotate as required to drill a bore or to make-up or break-out threaded connections in the drill string. Hydraulic cylinders 12*c* may be appropriately manipulated as required to raise and lower the drill head 12*a* and the pipe section P. Additional details in the construction and operation of a drilling snubber which may be employed for the snubber 12** may be obtained by reference to the previously mentioned U.S. Pat. No. 3,722,603.

The mast 11 and snubber 12 are mounted on a platform 13 which in turn is pivotally connected by pins 14 to a base structure 15. An hydraulic cylinder 16 connected between the mast and the base structure 15 is elongated or foreshortened in a conventional manner by the controlled application of pressurized hydraulic fluid from a suitable source (not illustrated). The dotted line representations of the mast illustrate representative inclined positions to which the mast may be moved by appropriate elongation or foreshortening of the cylinder 16. As will be readily apparent, when the mast and drilling snubber are inclined, the drill string and bit B produce a correspondingly inclined bore hole through the formation F.

The upper end of the drill pipe section P is engaged by an anchor means 17 which in turn is supported within the mast 11 by a traveling block 18. The traveling block 18 is supported in the mast 11 by a conventional wireline arrangement which extends through crown block sheaves **19*a* and includes a deadline 19*b* connected to the base platform 15 and an opposite fastline 19*c* connected onto the reel 19*d* of a drawworks assembly 19*e*. In conventional fashion, the drawworks assembly may be activated to take in the fastline or play it out as required to raise and lower the traveling block 18 as well as the attached anchoring means 17** and drill pipe section P.

Drilling fluids are supplied from a remote source (not illustrated) to the drill string via the anchoring means 17 and a fluid conduit 20. As will be more fully explained, in addition to supplying vertical lifting forces to the drill pipe P and providing a steadying support for the drill pipe during the drilling operation, the anchoring means 17 permits pressurized drilling fluids to be supplied to the rotating drilling pipe section P from the stationary supply line 20. A torque arm 21 securely fixed to the anchoring means 17 permits the anchoring means to be moved vertically through the mast 11 while nullifying any reactive rotational forces in the anchoring means 17 caused by rotation of the drill string. The torque arm 21 also provides a stabilizing structure which maintains the upper end of the drill pipe section P substantially centered in the mast even as the mast is inclined away from the vertical. Any suitable means for permitting longitudinal movement of the anchoring means while preventing relative lateral movement or rotational movement within the mast may be employed to provide the function of the torque arm 21.

The primary lifting of the drill string is performed by the drilling snubber 12 rather than the mast 11. The mast 11 must be of such size and strength as required to lift and position only a single pipe section and need not support the entire weight of the drill string which may be comprised of a very large number of such pipe sections. Thus, while the support platform 13, pins 14 and base structure 15 must have sufficient strength to support and manipulate the entire drill string, the mast itself may be relatively lightweight and small.

Figure 3:
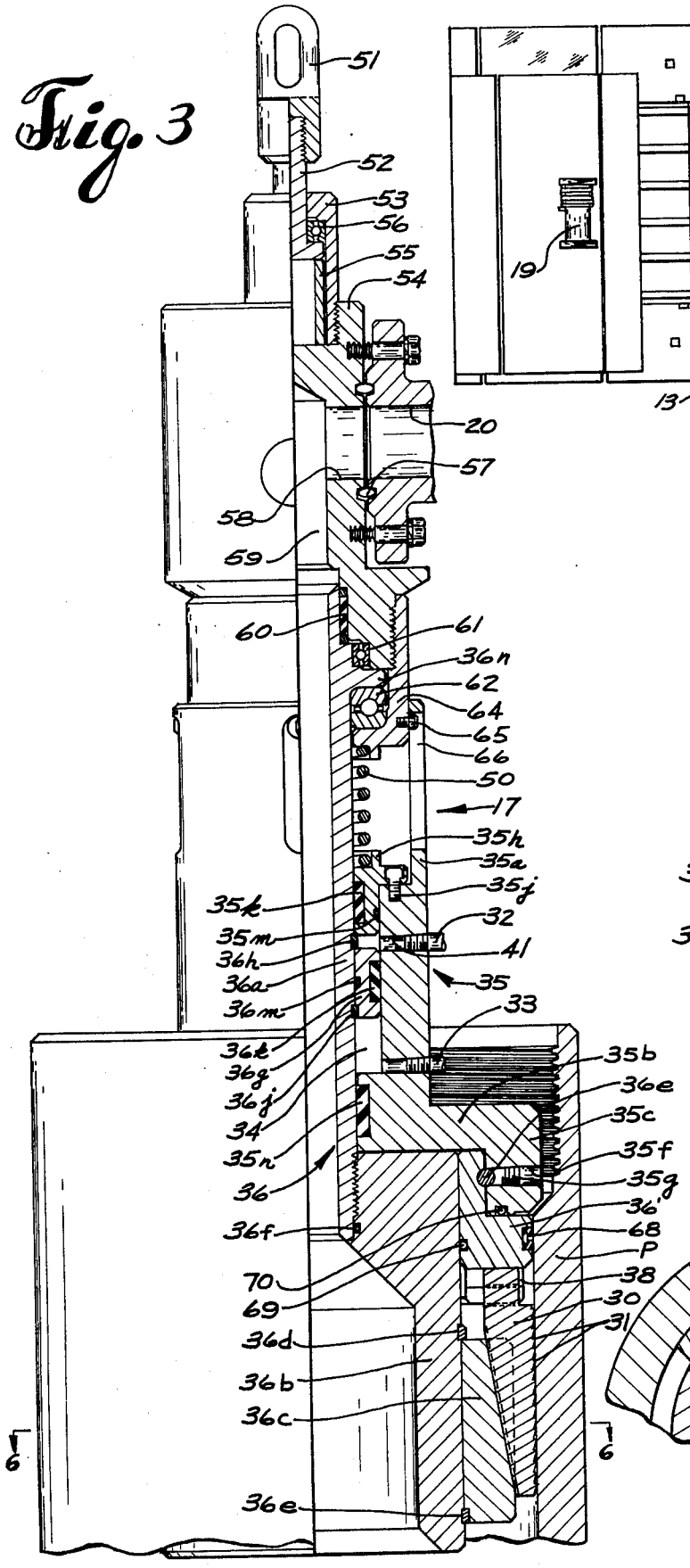
FIG. 3 is an enlarged scale vertical elevation, partially in section, illustrating the swiveling, gripping and sealing anchoring means of the present invention.
Figure 4:
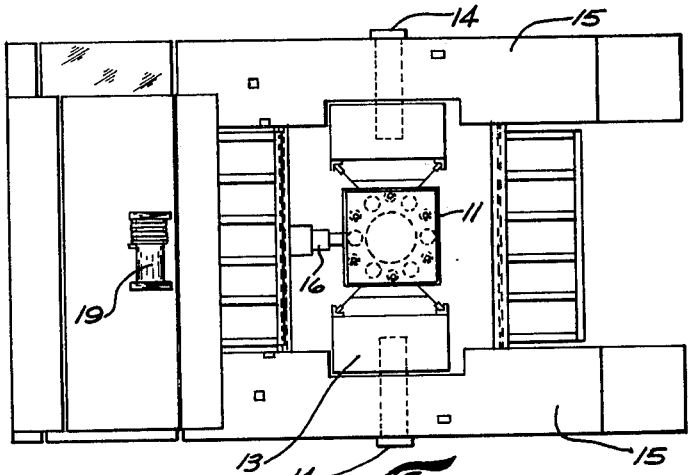
FIG. 4 is a horizontal cross-section taken along line 4—4 of FIG. 1.
Figure 5:
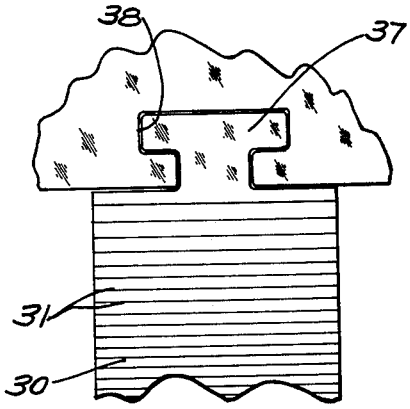
FIG. 5 is an enlarged scale view of a portion of the slip assembly employed in the anchoring means of the present invention.
Figure 6:
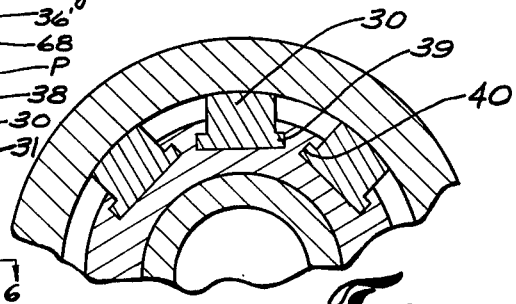
FIG. 6 is a partial horizontal cross-section on a reduced scale, taken along the line 6—6 of FIG. 3.

Referring jointly to FIGS. 3, 5 and 6, the anchoring means 17 includes a plurality of slip elements 30 which are movable radially outwardly into gripping engagement with the internal surface of the drill pipe section P. The slip elements include gripping teeth 31 which form a secure frictional engagement with the pipe section P to prevent relative movement between the pipe and the anchor means 17.

The slip elements 30 are moved radially relative to the pipe P by the application of pressurized fluid to the anchor head 17 through hydraulic lines 32 and 33. As will be more fully explained, the slip elements are moved radially outwardly when pressurized hydraulic fluid is supplied to the anchor means 17 through the line 33 and permitted to flow out of the anchor means through the line 32. The fluid from the line 33 causes an annular expansion chamber 34 to increase in size by driving an outer housing assembly 35 downwardly relative to a rotatable, central support assembly 36. This relative motion causes the slip elements to move outwardly.

The outer housing assembly includes a tubular outer portion **35*a* having a lower flange portion 35*b* supporting a lower skirt portion 35*c*. A slip support section 36' is connected to the skirt portion 35*c* by an arrangement which permits the section 36' to rotate relative to the portion 35*c* but prevents any longitudinal movement between the two components. The latter connection is formed by providing a series of ball bearings 35*e* which closely fit into mating annular grooves formed on the external surface of the section 36' and on the internal surface of the skirt portion 35*c*. The bearings 35*e* span the gap between the two components to prevent them from moving longitudinally relative to each other. A radial access opening 35*f* is employed to place the ball bearings 35*e* into the passage formed by the mating annular grooves and a plug 35*g* is threaded into the access opening 35*f*** to hold the bearings in place.

The upper end of the outer housing assembly 35 is provided with an annular seal mount member **35*h* which is secured to the outer housing portion 35*a* by a plurality of bolts 35*j*. A resilient annular seal ring 35*k* is carried in the seal mount 35*h* to form a sliding seal with an underlying tubular body 36*a* forming a portion of the central housing assembly 36. An annular O-ring seal 35*m*, also carried on the seal mount 35*h*, provides a leak-proof connection between the member 35*h* and the surrounding housing portion 35*a*. A lower resilient seal ring 35*n* carried on the flange portion 35*b* also provides a rotating seal with the body 36*a***.

The central support assembly 36 includes, in addition to the tubular body **36*a*, a wedge mounting body 36*b* which supports an annular slip wedging member 36*c*. The wedging member 36*c* is held in position by snap rings 36*d* and 36*e* positioned in annular grooves formed on the outer surface of the body 36*b*. An annular resilient O-ring seal 36*f* prevents pressure leakage through the threaded connection securing the tubular body 36*a* to the wedge mounting body 36*b***.

The central assembly 36 also includes an annular seal support ring **36*g* held in place on the tubular body 36*a* by snap rings 36*h* and 36*j*. A resilient annular seal ring 36*k*, mounted on the member 36*g*, forms a sliding seal with internal surface of the outer housing assembly portion 35*a*. An annular O-ring seal 36*m* prevents leakage between the seal support ring 36*g* and the underlying tubular body 36*a***.

As previously described, the application of hydraulic fluid through the line 33 to the chamber 34 causes the chamber to expand by moving the outer assembly 35 downwardly relative to the central assembly 36. The sliding sealing action of the seals **36*k* and 35*n* permits the two assemblies to move relative to each other without loss of fluid. This relative movement between the two assemblies causes the slip elements 30 to move downwardly relative to the wedging member 36*c*. The radially inner surfaces of the slip elements 30 are inclined and bear against oppositely inclined surfaces on the member 36*c*. The downward movement of the inclined surfaces of the slip elements 30 along the inclined surfaces on the member 36*c*** causes the slip elements to move radially outwardly into gripping engagement with the internal surface of the pipe section P.

A T-head 37 (FIG. 5) at the upper end of each slip element 30 is engaged in a correspondingly shaped T-slot 38 formed in the slip support portion 36' to permit radial movement of the slip elements 30 while preventing relative longitudinal movement between the slip elements and the outer assembly 35. Tongues 39 (FIG. 6) extending away from the sides of the slip elements 30 ride in inclined grooves 40 formed in the wedging member **36*c* so that the slip elements 30 are constrained to move radially inwardly as the outer assembly moves upwardly relative to the inner assembly. Such relative movement is effected by applying hydraulic pressure through the line 32 to a second expansion chamber 41 while the pressure in the first expansion chamber 34 is relieved. The application of fluid pressure to the chamber 41 expands the chamber while the seals 35*k* and 36*k* maintain a sliding seal which prevents loss of the fluid. Since the T-head connection prevents the slip elements 30 from remaining relatively stationary with the wedging member 36*c***, the tongue and groove connection between the slip elements and wedging member causes the slip elements to move radially inwardly out of engagement with the surrounding pipe P as the outer assembly moves upwardly.

A helical metal spring 50 exerts a biasing force which tends to move the outer assembly 35 downwardly and relative to the central assembly 36. This action tends to maintain the slip elements 30 in their radially expanded gripping position. By this means, when the anchoring means 17 is initially lowered into the upper end of the pipe section P, the teeth 31 on the slip elements 30 engage the inner surface of the pipe P, pushing the outer assembly upwardly relative to the central assembly against the biasing force of the spring 50. When the anchoring means 17 is raised upwardly by the traveling block, the biasing force of the spring 50 is effective to produce a radially outwardly directed force on the slip elements 30. Continued relative upward movement of the anchoring means 17 causes the inclined surfaces on the wedging member 36*c* to tend to move upwardly along the correspondingly inclined surfaces at the rear of the slip elements 30 while the frictional engagement of the slip element teeth 31 with the pipe section P resists upward movement of the slip elements.

The result is that as the central assembly 36 is pulled upwardly by the traveling block, a wedging action occurs which forces the slip elements 30 radially outwardly into firm anchoring engagement with the surrounding pipe P. By this means, it will be appreciated that the gripping function of the anchoring means 17 may be performed without need for the application of hydraulic pressure. This feature provides a quick latch action which may be employed for handling single pieces of the pipe without need for auxiliary hydraulic power and also functions to provide a failsafe anchoring operation which would prevent inadvertent dropping of the pipe in the event of an unexpected loss of hydraulic pressure. Moreover, the wedging effect between the wedging member 36*c* and the inclined surfaces of the slip elements 30 produces an ever-increasing radially directed gripping force as the forces tending to displace the pipe P and the anchoring means 17 increase, thus reducing the risk that the pipe and anchoring means will be separated. The application of hydraulic pressure through the line 32 overcomes the biasing effect of the spring 50 and also overcomes any binding or frictional locking of the slip elements to positively withdraw the slip elements from their anchoring engagement so that the pipe P may be released when desired.

In addition to providing the anchoring and release functions previously described, the anchoring means 17 also provides a leak-proof connection which permits drilling fluids supplied through the line 20 to be communicated to the pipe P while the latter is rotating.

Figure 2:
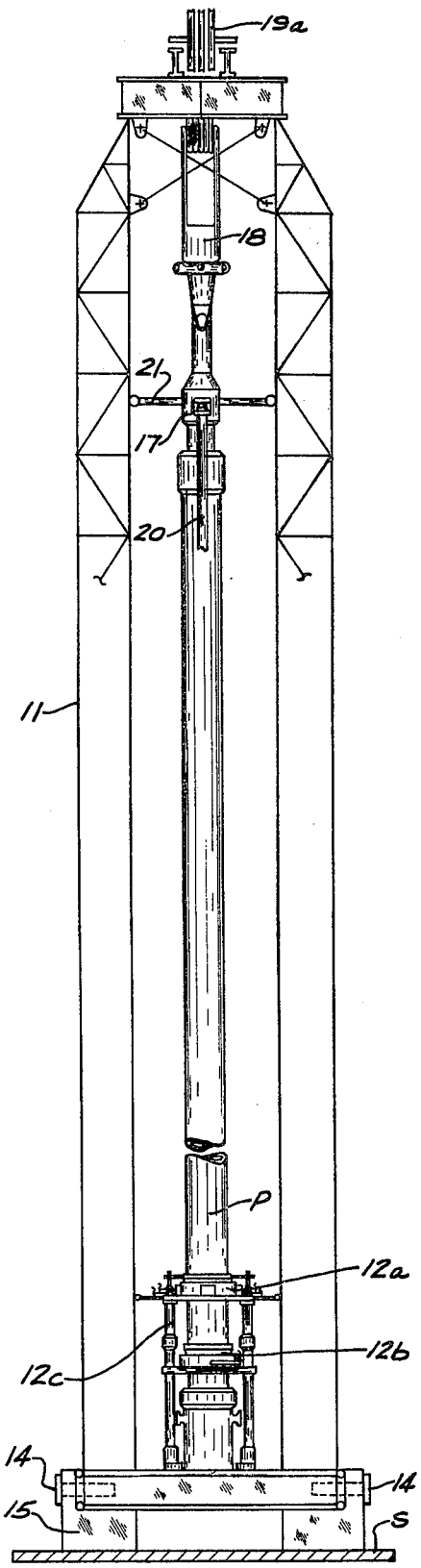
FIG. 2 is a side elevation of the assembly illustrated in FIG. 1.

Relative rotary motion in the anchor means 17 occurs between that portion of the anchoring means connected to the fluid conduit 20 and that portion connected to the rotating pipe section P. Included in the stationary portions of the anchor are an anchoring eye 51 which is connected to the traveling block 18, in the manner illustrated in FIGS. 1 and 2. The anchoring eye 51 is threadedly engaged to a T-headed shaft 52 encased within a connecter sub-assembly 53 which in turn is threadedly secured to a fluid conduit connector sub-assembly 54. The T-headed shaft 52 is held in position within the connector 53 by an annular shim 55. A ball bearing assembly 56 permits rotational movement between the T-head shaft 52 and connector 53.

The fluid conduit 20 is bolted to the connector sub-assembly 54. An annular compression seal 57 is employed to prevent leakage. The conduit 20 communicates through a radial port 58 formed in the sub-assembly 54 which in turn connects with an internal flow passage 59 formed in the anchor means 17. A resilient seal ring 60 provides a sliding seal between the stationary sub-assembly 54 and the rotatable tubular body 36*a*. A radial ball bearing assembly 61 centers the tubular body 36*a* within the lower end of the sub-assembly 54 and provides reduced frictional forces between the two components.

A thrust-bearing assembly 62 supports an annular flange 36*n* extending radially outwardly from the tubular body 36*a* to provide axial, rotational support for the body 36*a*. The ball bearing assembly 62 is held in place against the flange 36*n* by a retaining member 64 threadedly engaged to the lower end of the connector sub-assembly 54. Pins 65 extending radially from the member 64 extend into slots 66 formed in the outer assembly portion 35*a* to permit relative longitudinal movement between the inner and outer assemblies 36 and 35, respectively.

The slip support assembly 36' is equipped with annular seals 68 and 69 which cooperate with a seal 70 and the seals 36*f* and 60 to ensure a leak-proof flow passage between the fluid conduit 20 and the internal flow passage of the pipe section P.

During the drilling operation while the pipe section P is rotated, the slip elements 30, wedging member 36*c*, wedge mount body 36*b*, tubular body 36*a* and seal support ring 36*g* are rotatable while the remaining portions of the anchoring means 17 are relatively stationary. The anchoring means 17 thus permits high pressure drilling fluids to be supplied to the drill bit through the rotating drill string and simultaneously provides steadying and lifting support for the pipe section P extending upwardly from the drilling snubber 12.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. A drilling assembly for forming an inclined borehole comprising:

a. drilling snubber means having a gripping head and a drilling head movable relative to each other for moving a pipe means gripped by one of said heads along the longitudinal axis of said pipe means, said snubber means including means for rotating said pipe means about its longitudinal axis;

b. mast means extending above said drilling snubber means;

c. anchoring means carried in said mast means for attachment to said pipe means including:

i. gripping means movable radially between a first configuration for gripping engagement with said pipe means and a second configuration for release of said pipe means; and ii. swivel means for providing structural support between said mast means and said pipe means while said pipe means is rotated;

d. restraining means for preventing said anchoring means from counter-rotating when said pipe means is being rotated about its longitudinal axis, said restraining means further including means for maintaining said anchoring means at a predetermined lateral position relative to said mast means when said mast means is inclined away from the vertical; and e. pivot control means for inclining said mast means, gripping heads and pipe means to form inclined bore holes.

2. A drilling assembly as defined in claim 1 wherein said pivot control means includes:

a. a pivotally mounted support structure for supporting said snubber means and mast means; and b. pivot power means for moving said support structure about its pivotal axis.

3. A drilling assembly as defined in claim 1 wherein said anchoring means further includes rotary-to-stationary seal means for providing a sealed flow passage between a stationary fluid supply line and said pipe means while said pipe means is rotating.

4. A drilling assembly as defined in claim 3 further including hydraulically propelled powering means for moving said gripping means into and out of gripping engagement with said pipe means.

5. A drilling assembly as defined in claim 3 wherein said anchoring means includes force responsive means responsive to the displacement forces tending to longitudinally displace said pipe means from said gripping means in a given longitudinal direction for increasing the gripping force exerted by said gripping means as said displacement forces increase.

6. A drilling assembly as defined in claim 3 further including biasing means for urging said gripping means radially toward gripping engagement with said pipe means.

7. A drilling assembly as defined in claim 4 wherein said gripping means includes slip means and wedging means for moving said slip means laterally into engagement with said pipe means as said slip means and wedging means are moved longitudinally relative to each other.

8. A drilling assembly as defined in claim 7 wherein said wedging means is movable longitudinally by said hydraulic means while said slip means is stationary relative to said pipe means.

9. A drilling assembly as defined in claim 2 wherein said anchoring means further includes rotary-to-stationary seal means for providing a sealed flow passage between a stationary fluid supply line and said pipe means while said pipe means is rotating.

10. A drilling assembly as defined in claim 8 wherein said pivot control means includes:

a. a pivotally mounted support structure for supporting said snubber means and mast means; and b. pivot power means for moving said support structure about its pivotal axis.

11. A drilling assembly as defined in claim 10 wherein said anchoring means includes force responsive means responsive to the displacement forces tending to longitudinally displace said pipe means from said gripping means in a given longitudinal direction for increasing the gripping force exerted by said gripping means as said displacement forces increase.

12. A drilling assembly as defined in claim 11 further including biasing means for urging said gripping means radially toward gripping engagement with said pipe means.

* * * * *